US008133951B2

(12) United States Patent
Zhang et al.

(10) Patent No.: US 8,133,951 B2
(45) Date of Patent: Mar. 13, 2012

(54) MODIFIED POLYACRYLONITRILE FIBER AND METHOD OF PREPARING THE SAME

(75) Inventors: Xingxiang Zhang, Tianjin (CN); Jianhua Zhang, Qingdao (CN); He Cui, Tianjin (CN); Xuechen Wang, Tianjin (CN); Jianjin Niu, Tianjin (CN)

(73) Assignee: Hiking Group Co., Ltd., Qingdao (CN)

( * ) Notice: Subject to any disclaimer, the term of this patent is extended or adjusted under 35 U.S.C. 154(b) by 0 days.

(21) Appl. No.: 13/090,241

(22) Filed: Apr. 19, 2011

(65) Prior Publication Data

US 2011/0196091 A1 Aug. 11, 2011

Related U.S. Application Data

(63) Continuation of application No. 12/483,438, filed on Jun. 12, 2009, now abandoned, which is a continuation of application No. PCT/CN2007/003281, filed on Nov. 20, 2007.

(30) Foreign Application Priority Data

Dec. 12, 2006 (CN) ..... 2006 1 0130085

(51) Int. Cl.

| | |
|---|---|
| ***C08F 2/44*** | (2006.01) |
| ***C08K 11/00*** | (2006.01) |
| ***C08L 89/00*** | (2006.01) |
| ***C08L 1/00*** | (2006.01) |
| ***C08L 97/02*** | (2006.01) |

(52) U.S. Cl. ..... 524/702; 524/704; 264/184; 527/202

(58) Field of Classification Search ..... 524/704, 524/702; 264/184; 527/202

See application file for complete search history.

(56) References Cited

U.S. PATENT DOCUMENTS 3,786,822 A * 1/1974 Kimura et al. ..... 132/53

* cited by examiner

*Primary Examiner* — James J Seidleck
*Assistant Examiner* — Deve E Valdez
(74) *Attorney, Agent, or Firm* — Matthias Scholl P.C.; Matthias Scholl

(57) ABSTRACT

A modified polyacrylonitrile fiber and its preparation process and use are disclosed. An animal hair micro powder is used as a modifier for polyacrylonitrile polymer. The weight percent of a monomer composition is as follows: acrylonitrile monomer 50.0-98.8%, initiator 0.1-0.4%, animal hair micro powder 1.0-50.0%. The preparation process of the modified polyacrylonitrile fiber comprises the following steps: 1. preparing the animal hair micro powder suspension, 2. preparing spinning dope of the modified polyacrylonitrile fiber, 3. preparing the modified polyacrylonitrile fiber. The fiber is suitable for making artificial synthetic hair product such as hairpieces, and resembles well natural human hair.

7 Claims, No Drawings

MODIFIED POLYACRYLONITRILE FIBER AND METHOD OF PREPARING THE SAME

CROSS-REFERENCE TO RELATED APPLICATIONS

This application is a continuation of U.S. Ser. No. 12/483,438 filed on Jun. 12, 2009, now pending, which is a National Stage Application of International Patent Application No. PCT/CN2007/003281, with an international filing date of Nov. 20, 2007, which is based on Chinese Patent Application No. 200610130085.0 filed Dec. 12, 2006. The contents of all of these specifications are incorporated herein by reference.

BACKGROUND OF THE INVENTION

1. Field of the Invention

The invention relates to a synthetic fiber and method of preparing the same, and more particularly to a polyacrylonitrile fiber comprising polyacrylonitrile with animal hair micro powders as modifier, a method of preparing the modified polyacrylonitrile fiber, as well as applications thereof.

2. Description of the Related Art

Synthetic hair, as a substitute of human hair, has been used for the preparation of artificial hair for men and women. Generally, synthetic hair is made from polymer fibers. Since the beginning of 1970s, synthetic hair has been widely developed, resulting in the industrialization of various synthetic hair products consisting of polyethylene terephthalate, polyamide or polyacrylonitrile. However, the above-mentioned synthetic hair contained no proteins.

In order to effectively seize market share, synthetic hair should have all or most of the properties of human hair. A number of patent applications have disclosed some preparation process of synthetic hair. For example, International Patent Publication No. WO2005/033384 disclosed a method of preparing synthetic hair with polyvinyl chloride. The method was aimed at improving flame retardancy of the synthetic hair.

International Patent Publication No. WO2006/035868 disclosed a method of preparing synthetic hair including adding a plurality of flame retardants to polyalkylene terephthalate.

U.S. Patent Application No. 2006/0024497 disclosed a method of preparing synthetic hair with acrylonitrile. The method was aimed at improving the appearance of synthetic hair, and the resultant synthetic hair had flickering gloss.

However, the common disadvantages of the above synthetic hair were that the synthetic hair was composed of synthetic polymers, the chemical makeup of which was different from genuine human hair, so the properties of the synthetic hair such as gloss, handling and curling, were not as good as human hair.

International Patent Publication No. WO2006/002572 disclosed a method of preparing textile fibers containing biological proteins. The textile fibers consisted of wool protein and polyvinyl alcohol. However, the fibers were mainly used for preparation of clothes, and were not suitable for the preparation of synthetic hair because the textile fibers were highly hydrophilic, lacked waterproof capability, and their curling was significantly different from that of human hair.

SUMMARY OF THE INVENTION

In view of the above-described problems, it is an objective of the invention to provide a modified polyacrylonitrile fiber comprising polyacrylonitrile with animal hair micro powder as a modifier, and having similar properties to human hair.

It is another objective of the invention to provide a method of preparing a modified polyacrylonitrile fiber comprising polyacrylonitrile with an animal hair micro powder as modifier, and having similar properties to human hair.

It is still another objective of the invention to provide a method of using a modified polyacrylonitrile fiber comprising polyacrylonitrile with animal hair micro powder as a modifier, and having similar components and properties to human hair.

To achieve the above objectives, in accordance with one embodiment of the invention, provided is a starting solution for preparation of modified polyacrylonitrile fiber comprising polyacrylonitrile with animal hair micro powder as a modifier, the solution comprising:

an acrylonitrile monomer 49.9-98.9% by weight;

an initiator 0.1-0.4% by weight; and an animal hair micro powder 1.0-50.0% by weight;

the total weight percent of all components being 100%.

In a class of this embodiment, the acrylonitrile monomer is selected from acrylonitrile, methyl acrylonitrile, butenenitrile, and a mixture thereof; the molecular weight of the polyacrylonitrile is 15,000-120,000.

In another class of this embodiment, the initiator is: (i) a free radical initiator selected from azobisisobutyronitrile, azobisisoheptonitrile, benzoyl peroxide, and a mixture thereof; or (ii) an oxidation-reduction initiator selected from potassium persulfate-sodium bisulfite, ammonium persulfate-sodium bisulfite, sodium chlorate-sodium bisulfite, sodium hypochlorite-sodium bisulfite, and a mixture thereof In another class of this embodiment, the animal hair micro powder is obtained by a mechanical method from natural animal fibers selected from wool, cattle hair, horse hair, rabbit hair, camel hair, yak hair, and/or human hair. The average diameter of the animal hair micro powder particles is 0.01-10 μm.

In accordance with another embodiment of the invention, provided is a method of preparing a modified polyacrylonitrile fiber. Based on the above-mentioned composition of the modified polyacrylonitrile fiber, the method comprising the steps of:

1) preparing a suspension comprising animal hair micro powder: a) preparing animal hair micro powder by a mechanical method from wool, cattle hair, horse hair, rabbit hair, camel hair, yak hair, and/or human hair; b) mixing the animal hair micro powder with a solvent for dissolving polyacrylonitrile to give a suspension comprising animal hair micro powder; the solvent for dissolving polyacrylonitrile is optionally selected from the group consisting of 50-70% by weight zinc chloride solution, 60-73% by weight nitric acid solution, or 45-58% by weight sodium thiocyanate solution, N,N-dimethylformamide, N,N-dimethyl acetamide, dimethyl sulfoxide, acetone, or ethylene carbonate;
2) preparing a spinning dope of modified polyacrylonitrile fiber: initiating a polymerization between the suspension comprising animal hair micro powder and an acrylonitrile monomer, or among the suspension comprising animal hair micro powder, the acrylonitrile monomer, and/or a second monomer, and/or a third monomer by an initiator to give a spinning dope of modified polyacrylonitrile fiber comprising animal hair micro powder, the reaction time being 2-10 hours; or filtering the suspension comprising animal hair micro powder to give a wet cake, and uniformly mixing the wet cake with the acrylonitrile monomer, and/or the second monomer, and/or the third monomer to give a spinning dope of modified polyacrylonitrile fiber, the concentration of the spinning dope being 15-45% by weight; and 3) preparing a modified polyacrylonitrile fiber: preparing a modified polyacrylonitrile fiber from the spinning dope of modified polyacrylonitrile fiber by a solution spinning technology.

In another aspect, the invention provides a use of a modified polyacrylonitrile fiber. The fiber is used for the preparation of synthetic hair and various artificial hair products.

Advantages of the invention are summarized as follows:

1) The fiber comprises polyacrylonitrile and appropriate animal hair micro powder; either its components or properties are closer to those of human hair, so the fiber is a better substitute for human hair;
2) The preparation method of the fiber is simple, low cost, and easy to mass produce, and does not need special equipment and treatment; and
3) The fiber is particularly suitable for the preparation of synthetic hair, e.g., wigs and wig sheaths resembling well human hair.

DETAILED DESCRIPTION OF THE EMBODIMENTS

In one embodiment of the invention, provided is a composition useful for preparing a modified polyacrylonitrile fiber (hereinafter referred to as "modified fiber") comprising polyacrylonitrile with animal hair micro powder as a modifier, the composition comprising:

acrylonitrile monomer 49.9-98.9% by weight;
initiator 0.1-0.4% by weight; and
animal hair micro powder 1.0-50.0% by weight;
the total weight percent of all components being 100%.

The acrylonitrile monomer used in compositions and methods of the invention is selected from acrylonitrile, methyl acrylonitrile, butenenitrile, and a mixture thereof; and the molecular weight of the polyacrylonitrile is 15,000-120,000.

The initiator is a free radical initiator selected from azobisisobutyronitrile, azobisisoheptonitrile, benzoyl peroxide, or a mixture thereof; or an oxidation-reduction initiator selected from potassium persulfate-sodium bisulfite, ammonium persulfate-sodium bisulfite, sodium chlorate-sodium bisulfite, sodium hypochlorite-sodium bisulfite, and a mixture thereof.

The animal hair micro powder are prepared by a mechanical method from natural animal fibers selected from wool, cattle hair, horse hair, rabbit hair, camel hair, yak hair and/or human hair. The average diameter of the animal hair micro powder particles is 0.01-10 μm.

The above-mentioned weight proportions are for illustration only. In the formula, the initiator content is very low. In some cases, when the initiators are added, the weight percent of acrylonitrile monomers and/or animal hair micro powder may be decreased so that the total weight percent of all components is 100%.

The acrylonitrile monomer used in compositions and methods of the invention is selected from acrylonitrile, methyl acrylonitrile, butenenitrile, and a mixture thereof. Different acrylonitrile monomers have different price, and affect the cost and price of the final products, but do not affect the implementation of the invention.

In order for the modified polyacrylonitrile fiber to have good flame retardancy, curling, and natural gloss, a second monomer can be optionally added to copolymerize with the acrylonitrile monomers.

The second monomer is selected from acrylic acid, methyl acrylate, ethyl acrylate, butyl acrylate, 2-hydroxyethyl acrylate, methacrylic acid, methyl methacrylate, ethyl methacrylate, propyl methacrylate, butyl methacrylate, 2-hydroxyethyl methacrylate, styrene, methyl styrene, vinyl acetate, methylene butanedioic acid, vinyl chloride, vinylidene chloride, vinyl bromide, vinylidene bromide, vinylidene fluoride, and a mixture thereof.

After introduction of the second monomer, a composition for preparing a modified polyacrylonitrile fiber of the invention comprises:

a first acrylonitrile monomer 30.0-96.9% by weight;
an initiator 0.1-0.4% by weight;
an animal hair micro powder 1.0-50.0% by weight; and
a second monomer 2.0-20.0% by weight;
the total weight percent of all components being 100%.

The weight percent of the second monomer in all the components of the fiber is 2.0-20.0%, particularly 3.0-18.0%, and more particularly 5.0-15.0%.

If the content of the second monomer is too low, the structure and properties of the polyacrylonitrile fiber will not be improved. If the content of the second monomer is too high, the property difference between the modified fiber and a common polyacrylonitrile fiber may be relatively high, which may make the modified polyacrylonitrile fiber lose its original handling and bulking property.

In the formula of the modified polyacrylonitrile fiber, when the second monomer is added, the weight percent of acrylonitrile monomers and/or animal hair micro powder may be decreased so that the total weight percent of all components is 100%.

The addition of the second monomer can improve all or part of flame retardancy of the fiber. When the second monomer selected from vinyl chloride, vinylidene chloride, vinyl bromide, vinylidene bromide, vinylidene fluoride, or a mixture thereof is added, and the modified polyacrylonitrile fiber has much better flame retardancy. Subject to the content of the second monomer, the limiting oxygen index of the fiber may reach 22-28% or more. The flame retardancy is very important for synthetic hair, so the above-mentioned second monomers are preferable.

Additionally, based on special needs, other type of second monomers are also practicable.

In the invention, the components and structure of the modified polyacrylonitirle fiber are flexibly controlled by adjusting the type and amount of the second monomer, and the resultant modified polyacrylonitrile fiber has a good flame retardancy, curling, and natural gloss.

In another embodiment of the invention, a third monomer may be added to the mixture for preparing a modified polyacrylonitrile fiber. After introduction of the third monomer, the mixture for preparing the polyacrylonitrile fiber of the invention comprises:

a first acrylonitrile monomer 20.0-96.8% by weight;
an initiator 0.1-0.4% by weight;
an animal hair micro powder 1.0-50.0% by weight;
a second monomer 2.0-20.0% by weight; and
a third monomer 0.1-10.0% by weight;
the total weight percent of all components being 100%.

The third monomer has dye affinity groups, and is selected from sodium methacrylate sulfonate, sodium methallyl sulfonate, sodium allylsulfonate, sodium styrene sulfonate, sodium vinyl sulfonate, sodium vinyl sulfonate, sulfoalkyl acrylate, sulfoalkyl methacrylamide, or a mixture thereof.

The addition of the third monomer can improve the dyeing property of the modified polyacrylonitrile fiber.

In the formula of the modified polyacrylonitrile fiber, when the third monomer is added, the weight percent of the acrylonitrile monomers, and/or the second monomer, and/or animal hair micro powder may be decreased so that the total weight percent of all components is 100%.

The weight percent of the third monomer in all the components of the fiber is 0.1-10.0%, particularly 0.4-4.0%, and more particularly 0.5-3.0%.

The addition of the third monomer, or the second monomer and the third monomer to the above-mentioned basic formula has no influence on the implementation of the invention. However, the weight percent of all components should be adjusted accordingly. The addition of the third monomer is beneficial to the preparation of a series of modified fibers having specific components and content.

Based on the various formula having different components and contents, a series of modified polyacrylonitrile fibers are prepared.

The preparation method comprises the steps of:

1) preparing a suspension comprising animal hair micro powder: a) preparing animal hair micro powder by a mechanical method from wool, cattle hair, horse hair, rabbit hair, camel hair, yak hair, and/or human hair, the average diameter of the obtained micro powder particles being 0.01-10 μm; b) uniformly mixing the animal hair micro powder with a solvent for dissolving polyacrylonitrile to give a suspension comprising animal hair micro powder; the solvent for dissolving polyacrylonitrile is optionally selected from the group consisting of 50-70% by weight zinc chloride solution, 60-73% by weight nitric acid solution, or 45-58% by weight sodium thiocyanate solution, N,N-dimethylformamide, N,N-dimethyl acetamide, dimethyl sulfoxide, acetone, or ethylene carbonate;
2) preparing a spinning dope of modified polyacrylonitrile fiber: initiating a polymerization between the suspension comprising animal hair micro powder and an acrylonitrile monomer to give a spinning dope of modified polyacrylonitrile fiber comprising animal hair micro powder, the reaction time being 2-10 hours; or filtering the suspension comprising animal hair micro powder to give a wet cake, and uniformly mixing the wet cake with the acrylonitrile monomer according to a certain proportion to give a spinning dope of modified polyacrylonitrile fiber, the concentration of the spinning dope being 15-45% by weight;
3) preparing a modified polyacrylonitrile fiber: preparing a modified polyacrylonitrile fiber comprising animal hair micro powder from the spinning dope of modified polyacrylonitrile fiber by a solution spinning technology.

In step 2, when the second monomer, the third monomer, or a mixture thereof is added to the basic formula, the polymerization between the suspension comprising animal hair micro powder and the acrylonitrile monomer initiated by the initiators proceeds. Optionally, a polyacrylonitrile solution, or a copolymer solution comprising acrylonitrile and the second monomer or the third monomer, or a copolymer solution comprising acrylonitrile, the second monomer, and the third monomer, can be firstly prepared. Then to the solution, the suspension comprising animal hair micro powder can be added to give a spinning dope of modified fibers. The modification of components and content within the formulas has no influence on the preparation of the fiber.

In one embodiment of the invention, the preferable initiator of initiating the polymerization is a free radical initiator selected from azobisisobutyronitrile, azobisisoheptonitrile, benzoyl peroxide, or a mixture thereof; or an oxidation-reduction initiator selected from potassium persulfate-sodium bisulfite, ammonium persulfate-sodium bisulfite, sodium chlorate-sodium bisulfite, sodium hypochlorite-sodium bisulfite, and a mixture thereof.

Experiments have shown that the weight percent of the initiators in all the components of the fiber is 0.1-0.4%, particularly 0.1-0.35%, and more particularly 0.1-0.3%. If the content of the initiators is too low, the induction period of the polymerization will be prolonged, which is not conductive to increasing efficiency. If the content of the initiators is too high, the reaction will occur quickly, which may lead to runway polymerization and loss of control of the polymerization process.

In order to better control the molecular weight distribution of the polyacrylonitrile, in the process of polymerization between the suspension comprising animal hair micro powder and the acrylonitrile monomer, or between the suspension comprising animal hair micro powder, the acrylonitrile monomer, and the second monomer or the third monomer, or between the suspension comprising animal hair micro powder, the acrylonitrile monomer, the second monomer, and the third monomer, a certain amount of chain transfer agents can be added. The chain transfer agent is selected from dodecyl mercaptan, N-octyl mercaptan, β-mercaptoethanol, and isopropanol.

The weight percent of the chain transfer agents in all the components of the fiber is 0.1-0.6%, particularly 0.1-0.5%, and more particularly 0.2-0.4%. Experiments have shown when the weight percent of the chain transfer agents is less than 0.2%, it is difficult to control the molecular weight distribution of the acrylonitrile copolymer. When the weight percent of the chain transfer agents is more than 0.4%, on the one hand, a lot of materials are wasted; on the other hand; the molecular weight of polymer will be decreased, and further the properties of the polyacrylonitrile will be degraded. Actually, in the formula, the content of the chain transfer agents is very low. In some cases, when the agents are added, the weight percent of the acrylonitrile monomer, and/or the second monomer, and/or the third monomer, and/or animal hair micro powder may be decreased optionally so that the total weight percent of all components is 100%.

The animal hair refers to not only animal hair, but also animal hair waste or villi. The animal hair micro powder are prepared by any length or diameter of the hair, i.e., the hair is collected, impurities removed, washed by water, dried, crushed, and ground into micro powder.

The average diameter of animal hair micro powder particles is 0.01-10 μm, particularly 0.03-5 μm, and more particularly 0.05-3 μm. If the diameter of animal hair micro powder particles is less than 0.05 μm, the specific surface area is very large, which results in a difficult mixing with modified polyacrylonitrile, and results in particle conglomeration, difficult processing, and a high production cost. If the diameter of animal hair micro powder particles is more than 3 μm, the spinning dope will be difficult for filtering, and even block the spinneret.

The weight percent of the animal hair micro powder in all the components is 1.0-50.0%, particularly 5.0-45.0%. If the weight percent of the animal hair micro powder is lower than 5.0%, the modification effect of the fiber is not obvious. If the weight percent of the animal hair micro powder is more than 45.0%, the spinning process will become difficult, and the physical and mechanical properties of the prepared synthetic hair are decreased. However, it should be noted that, even if the weight percent of the animal hair micro powder is more than 45.0%, the fibers of the invention can still be produced.

The mechanical method of preparing animal hair micro powder comprising jet milling method, ball milling method, and grinding method. The grinding method, e.g., stirring ball milling method, vibrating ball milling method, high pressure roller grinding method, and colloid milling method, is preferable. Equipment required for these methods for processing animal hair micro powder does not need special modifications, just to modify grinding process according to hair type, which is within the field of those skilled in the art.

The solvent for dissolving polyacrylonitrile is an inorganic solvent comprising 50-70% by weight zinc chloride solution, 60-73% by weight nitric acid solution, or 45-58% by weight sodium thiocyanate solution, or an organic solvent comprising N,N-dimethylformamide, N,N-dimethyl acetamide, dimethyl sulfoxide, acetone, or ethylene carbonate. The weight percent of zinc chloride solution is preferably 53-67%. The weight percent of nitric acid solution is preferably 60-73%. The weight percent of sodium thiocyanate solution is preferably 48-55%. If the concentration of the solution is too high, materials will be wasted and the solvent is difficult for recycling. If the concentration of the solution is too low, the dissolution may be insufficient, and the stability of the spinning dope will decrease. The organic solvent must not include water, or the solubility will decrease.

The weight percent of the spinning dope of the modified fibers is generally 15-45%. But when the modified fibers are used for the preparation of synthetic hair, the concentration of spinning dope should be higher than that of common polyacrylonitrile spinning dope. Therefore, the total content of polyacrylonitrile and animal hair micro powder is generally 21-40% by weight, particularly 23-38% by weight, and more particularly 25-35% by weight. If the concentration is lower than 25%, the viscidity will be low, resulting in difficulty in forming synthetic hair having a compact structure and without interspace. If the concentration is higher than 35%, the spinning dope will be gelated heavily, resulting in a decreased stability.

In the invention, there provided are two methods for the preparation of the spinning dope of the modified fibers: the one being initiating a polymerization between the suspension comprising animal hair micro powder and the acrylonitrile monomer by an initiator at 30-70° C. to give a spinning dope of modified polyacrylonitrile fiber comprising animal hair micro powder, the reaction time being 2-10 hours; the other being filtering the suspension comprising animal hair micro powder at 30-70° C. to give a wet cake, and uniformly mixing the wet cake with the acrylonitrile monomer to give a spinning dope of modified polyacrylonitrile fiber.

The modified fibers of the invention are particularly suitable for the preparation of synthetic hair, wigs and wig sheaths.

The solution spinning technology of the invention comprises dry spinning, wet spinning, and dry-wet spinning All are suitable for the preparation of the modified fibers of the invention. The spinning process of the invention is the same as that for preparing conventional modified polyacrylonitrile fibers in spinning temperature, water washing, stretching, and heat treatment, and so on. However, when the prepared modified fibers of the invention is used for preparing synthetic hair, due to high concentration of spinning dope, the selected spinneret should have larger diameter of spinneret hole, or the spinning dope will be difficult for extruding. Generally, the diameter of spinneret hole for spinning cloth fiber is 0.05-0.15 mm, while the diameter of spinneret hole of the invention for spinning modified fibers for synthetic hair is 0.15-0.60 mm, particularly 0.18-0.55 mm, and more particularly 0.20-0.50 mm. In the process of spinning, the diameter of spinneret hole can be modified as needed, which is not beyond the skill of those skilled in the art.

The diameter of human hair is affected by factors such as ethnic origin, sex, heredity, and age, but generally, the filament titer is 30-100 dtex. However, the filament titer of ordinary textile fibers is less than 10 dtex. To enable the appearance and properties of synthetic hair of the invention close to that of human hair, the filament titer of the fibers should also be close to that of human hair. The filament titer of the fibers of the invention is 30-100 dtex, and can be adjusted as needed. The filament titer of fibers of the invention can go beyond the range of 30-100 dtex, which does not involve in any technical difficult. In order that the modified polyacrylonitrile fibers can be used for the preparation of stimulation synthetic hair, in one embodiment of the invention, high concentration of spinning dope (mentioned before) is applied, while the concentration of the spinning dope for preparing ordinary textile fibers is no more than 20%.

The spinning method of the modified fibers of the invention is affected by the molecular weight and the molecular weight distribution of polyacrylonitrile. In accordance with the objectives of the invention, particularly for the preparation of synthetic hair, the molecular weight of the polymers is 15000-120000, particularly 20000-100000, and more particularly 25000-90000. When the molecular weight of the polymers is lower than 25000, the viscidity of the spinning dope is low, resulting in bad physical and mechanical properties of fibers. When the molecular weight of the polymers is more than 90000, the viscidity of the spinning dope is too heavy, resulting in difficulty in spinning Experiments have shown that the synthetic hair prepared by the fibers of the invention is very similar to human hair in handling, gloss, flame retardancy, and dyeability. The synthetic hair of the invention is obviously superior to the existing synthetic hair, has a good simulation effect, and is particularly suitable for the preparation of synthetic hair, wigs and wig sheaths. The preparation process is simple and low cost, so the synthetic hair of the invention has a wide development and application prospect.

For further illustrating the invention, some examples are given below. It should be noted that the following examples are intended to describe only and not to limit the invention.

EXAMPLE 1

Human hair wastes with length of 1-5 mm were collected, impurities removed, washed with water, and dried. To a stirring ball miller (15 L), 2000 g of the dried hair waste, 1000 g of zirconia grinding balls with diameter of 5 mm, 2000 g of zirconia grinding balls with diameter of 2 mm, and 4000 g of deionized water were separately added. The mixture was stirred at room temperature for 6 hours, and then the zirconia grinding balls were filtered out. Observed under a microscope, most hair waste in the mixture had been ground into spherical powders, only a small number of rod-like particles remained. The mixture was transferred to a colloid mill and ground for 2 hours to yield spherical particles. After filtration, 3500 g of human hair micro powder aqueous solution was obtained. Analysis had showed there were 1900 g of human micro powder in the solution, basically spherical powders, with particle diameter of 0.05-2.1 μm. The excess water was filtered out and a wet cake comprising human hair micro powder obtained.

To a polymerizer (15 ) equipped with a mechanical stirrer and reflux condenser, 1500 g of deionized water and 2500 g of zinc chloride were added. The resultant mixture was stirred uniformly for 2 hours at 50° C. to give a uniform solution. The polymerizer was flushed by nitrogen, and then 5000 g of acrylonitrile, 2000 g of vinylidene bromide, 215 g of sodium methacrylate sulfonate, and 29 g of dodecyl mercaptan were added, and after uniform mixing, 15 g of ammonium persulfate and 30 g of sodium bisulfite were further added. The resultant mixture was stirred for 3 hours at 45° C., and the obtained human hair micro powder was added. After uniform mixing, a spinning dope of synthetic hair containing human hair micro powder was obtained. The spinning dope was deaerated at 70° C., measured by a metering pump (1.20 mL/rotation), extruded by a spinneret (72 holes×0.3 mm), and transferred to a zinc chloride solution (20% by weight) for solidification. The resultant products were washed with water, stretched, dried, shaped, and wound to yield synthetic hair.

The prepared synthetic hair comprised 21.2% by weight human hair micro powder, with the filament titer 93 dtex, the limiting oxygen index 28. Their handling, appearance, curling and dyeability were close to that of human hair. Wigs and wig sheaths prepared by the synthetic hair had a good simulation effect and internal quality.

EXAMPLE 2

A wet cake comprising human hair micro powder was prepared following the method in Example 1, and then 1200 g of deionized water were added.

To a polymerizer (15 ) equipped with a mechanical stirrer and reflux condenser, the human hair micro powder and 2500 g of zinc chloride were added. The resultant mixture was stirred uniformly for 2 hours at 50° C. to give a uniform solution. The polymerizer was flushed by nitrogen, and then 5000 g of methyl acrylonitrile, 2000 g of vinylidene chloride, 215 g of sodium allylsulfonate, and 29 g of isopropanol were added, and after uniform mixing, 45 g of benzoyl peroxide was further added. The resultant mixture was stirred for 5 hours at 55° C. to give a spinning dope containing human hair micro powder. The spinning dope was deaerated at 70° C., measured by a metering pump (1.20 mL/rotation), extruded by a spinneret (72 holes×0.3 mm), and solidified in a 10 cm air layer. The resultant products were washed with water, stretched, dried, shaped, and wound to yield synthetic hair.

The prepared synthetic hair comprised 22% by weight human hair micro powder, with the filament titer 94 dtex, the limiting oxygen index 28. Their handling, appearance, curling and dyeability were close to that of human hair. Wigs and wig sheaths prepared by the synthetic hair had a good simulation effect and internal quality.

EXAMPLE 3

A wet cake comprising human hair micro powder was prepared following the method in Example 1, and then 2000 g of deionized water were added to give a suspension.

To a polymerizer (15 L) equipped with a mechanical stirrer and reflux condenser, the human hair micro powder and 2500 g of sodium thiocyanate were added. The resultant mixture was stirred uniformly for 2 hours at 50° C. to give a uniform solution. The polymerizer was flushed by nitrogen, and then 5000 g of acrylonitrile, 2000 g of methyl acrylonitrile, 215 g of sodium allylsulfonate, and 29 g of dodecyl mercaptan were added, and after uniform mixing, 45 g of azobisisobutyronitrile were further added. The resultant mixture was stirred for 5 hours at 55° C. to give a spinning dope containing human hair micro powder. The spinning dope was deaerated at 70° C., measured by a metering pump (1.20 mL/rotation), extruded by a spinneret (72 holes×0.4 mm), and transferred to a sodium thiocyanate solution (20% by weight) for solidification. The resultant products were washed with water, stretched, dried, shaped, and wound to yield synthetic hair.

The prepared synthetic hair comprised 20% by weight human hair micro powder, with the filament titer 98 dtex, the limiting oxygen index 20. Their handling, appearance, curling and dyeability were close to that of human hair. Wigs and wig sheaths prepared by the synthetic hair had a good simulation effect and internal quality.

EXAMPLE 4

Wool was collected, impurities removed, washed with water, and dried. To a stirring ball miller (15 L), 2000 g of the dried wool, 1000 g of aluminum oxide grinding balls with diameter of 6 mm, 2000 g of aluminum oxide grinding balls with diameter of 3 mm, and 4000 g of N,N-dimethylformamide were separately added. The mixture was stirred at room temperature for 10 hours, and then the aluminum oxide grinding balls were filtered out. Observed under a microscope, most wool in the mixture had been ground into spherical powders. The mixture was transferred to a colloid mill and ground for 3 hours to yield spherical particles. After filtration, 3500 g of wool micro powder containing N,N-dimethylformamide were obtained. Analysis showed there were 1900 g of wool micro powder, basically spherical powders, with particle diameter 0.06-2.3 μm.

To a polymerizer (15 L) equipped with a mechanical stirrer and reflux condenser, the wool micro powder suspension was added and stirred uniformly for 2 hours at 50° C. to give a uniform solution. The polymerizer was flushed by nitrogen, and then 5215 g of acrylonitrile, 2000 g of vinylidene chloride and 29 g of N-octyl mercaptan were added, and after uniform mixing, 45 g of benzoyl peroxide were further added. The resultant mixture was stirred for 5 hours at 55° C. to give a spinning dope containing wool micro powder. The spinning dope was deaerated at 70° C., measured by a metering pump (1.20 mL/rotation), extruded by a spinneret (72 holes×0.3 mm), and solidified firstly in a 10 cm air layer, then in a N,N-dimethylformamide solution. The resultant products were washed with water, stretched, dried, shaped, and wound to yield synthetic hair.

The prepared synthetic hair comprised 20% by weight wool micro powder, with the filament titer 120 dtex, the limiting oxygen index 29. Their handling, appearance, curling and dyeability were close to that of human hair. Due to having no third monomer, the dyeability was bad. However, wigs and wig sheaths prepared by the synthetic hair still have a good simulation effect and internal quality.

EXAMPLE 5

100 g of wool micro powder were prepared following the method in Example 4.

To a polymerizer (15 ) equipped with a mechanical stirrer and reflux condenser, 3000 g of dimethyl sulfoxide were added, and the temperature was adjusted at 50° C. The polymerizer was flushed by dry nitrogen, and then 3000 g of acrylonitrile, 1000 g of methyl acrylonitrile, 1000 g of butenenitrile, 2000 g of vinylidene fluoride, 300 g of sodium styrene sulfonate, and 29 g of dodecyl mercaptan were added. After uniform mixing, 45 g of azobisisoheptonitrile were further added. The resultant mixture was stirred for 5 hours at 60° C. to give a polyacrylonitrile solution. To the solution, the wool micro powder were added and mixed uniformly at 60° C. to give a spinning dope comprising wool micro powder. The spinning dope was deaerated at 70° C., measured by a metering pump (2.40 mL/rotation), extruded by a spinneret (108 holes×0.3 mm), and solidified firstly in a 10 cm air layer, then in a 40% by weight dimethyl sulfoxide aqueous solution. The resultant products were washed with water, stretched, dried, shaped, and wound to yield synthetic hair.

The prepared synthetic hair comprises 5% by weight wool micro powder, with the filament titer 95 dtex, the limiting oxygen index 26. Their handling, appearance, curling and dyeability were close to that of human hair. Wigs and wig sheaths prepared by the synthetic hair had a good simulation effect and internal quality.

EXAMPLE 6

Camel hair was collected, impurities removed, washed with water, and dried. 1600 g of the dried camel hair was ground by a vibrating ball miller to give 1500 g of camel hair micro powder (200 mesh). The micro powder were mixed with 2200 g of N,N-dimethyl acetamide and ground in a colloid miller for 2 hours. After filtration, 3000 g of camel hair micro powder containing N,N-dimethyl acetamide were obtained. Analysis showed there were 1400 g of camel hair micro powder, completely spherical powders, with particle diameter 0.08-2.9 μm. The camel hair micro powder was collected to prepare a wet cake.

To a polymerizer (15 ) equipped with a mechanical stirrer and reflux condenser, 3500 g of N,N-dimethyl acetamide were added, and the temperature was adjusted at 65° C. The polymerizer was flushed by nitrogen, and then 5000 g of acrylonitrile, 2000 g of vinylidene fluoride, 200 g of sodium methacrylate sulfonate, 15 g of sodium styrene sulfonate, and 24 g of β-mercaptoethanol were added. After uniform mixing, 30 g of potassium persulfate and 10 g sodium bisulfite were further added. The resultant mixture was stirred for 4 hours at 50° C.

The wet cake comprising camel hair micro powder was added to the polymerizer, and uniformly stirred to give a spinning dope comprising camel hair micro powder. The temperature was adjusted at 65° C., and the spinning dope was measured by a metering pump (2.40 mL/rotation), extruded by a spinneret (98 holes×0.25 mm), and solidified in a 45% by weight N,N-dimethyl acetamide aqueous solution. The resultant products were washed with water, stretched, dried, shaped, and wound to yield synthetic hair.

The prepared synthetic hair comprised 16.3% by weight animal hair micro powder, with the filament titer 86 dtex, the limiting oxygen index 27. Their handling, appearance, curling and dyeability were close to that of human hair. Wigs and wig sheaths prepared by the synthetic hair had a good simulation effect and internal quality.

EXAMPLE 7

A spinning dope comprising camel hair micro powder was prepared following the method in Example 6. The spinning dope flowed into spinning channels with a set temperature of 150° C. via a spinneret (98 holes×0.25 mm). After dried and solvent removed, stimulation synthetic hair was obtained.

The prepared synthetic hair comprises 16.3% by weight animal hair micro powder, with the filament titer 85 dtex, the limiting oxygen index 27. Their handling, appearance, curling and dyeability were close to that of human hair. Wigs and wig sheaths prepared by the synthetic hair had a good simulation effect and internal quality.

EXAMPLE 8

A spinning dope comprising camel hair micro powder was prepared following the method in Example 6. The spinning dope flowed into 45% by weight N,N-dimethyl acetamide aqueous solution directly for solidification via a spinneret (98 holes×0.25 mm). The resultant products were washed with water, stretched, dried, shaped, and wound to yield synthetic hair.

The prepared synthetic hair comprised 16.3% by weight animal hair micro powder, with the filament titer 86 dtex, the limiting oxygen index 27. Their handling, appearance, curling and dyeability were close to that of human hair. Wigs and wig sheaths prepared by the synthetic hair had a good simulation effect and internal quality.

EXAMPLE 9-13

Animal hair micro powders were prepared following the method in Example 1 except that the human hair waste was separately substituted with wool, camel hair, rabbit hair, horse hair, and yak hair. The other preparation processes were the same as that in Example 1.

EXAMPLE 14-18

Animal hair micro powders were prepared following the method in Example 4 except that the wool was separately substituted with human hair, camel hair, rabbit hair, horse hair, and yak hair. The other preparation processes were the same as that in Example 4.

EXAMPLE 19-23

Animal hair micro powder were prepared following the method in Example 6 except that the camel hair was separately substituted with human hair waste, wool, rabbit hair, horse hair, and yak hair. The other preparation processes were the same as that in Example 6.

COMPARISON EXAMPLE

To a polymerizer (15 ) equipped with a mechanical stirrer and reflux condenser, 1500 g of deionized water were added. The polymerizer was flushed by nitrogen, and 2500 g of zinc chloride was added. The mixture in the polymerizer was stirred uniformly for 2 hours at 50° C. to give a uniform solution. To the solution, 1500 g of acrylonitrile, 100 g of chloroethylene, 41.5 g of sodium methacrylate sulfonate, and 32 g of isopropanol were added, and after uniform mixing, 15 g of ammonium persulfate and 29 g of sodium bisulfite were further added. The resultant mixture was stirred for 3 hours at 50° C., and a uniform acrylonitrile spinning dope was obtained. The spinning dope was measured by a metering pump (2.40 mL/rotation), and transferred to a spinneret (200 holes×0.15 mm) for spinning The resultant products were solidified in deionized water, washed with water, stretched, dried, shaped and wound to yield fibers with the filament titer of 76 dtex.

The components, handling and appearance of the fibers have a huge difference from that of human hair. Therefore, the fibers prepared by the method can only be used for preparation of low grade synthetic hair products.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A composition useful for preparing a modified polyacrylonitrile fiber comprising polyacrylonitrile and animal hair micro powder, the composition comprising:

49.9-98.9% by weight of an acrylonitrile monomer;

0.1-0.4% by weight of an initiator; and 1.0-50.0% by weight of an animal hair micro powder; wherein, said acrylonitrile monomer is selected from acrylonitrile, methyl acrylonitrile, and butenenitrile;

said initiator is a free radical initiator selected from azobisisobutyronitrile, azobisisoheptonitrile, benzoyl peroxide, or a mixture thereof; or an oxidation-reduction initiator selected from potassium persulfate-sodium bisulfite, ammonium persulfate-sodium bisulfite, sodium chlorate-sodium bisulfite, sodium hypochlorite - sodium bisulfite, or a mixture thereof; and said animal hair micro powder is prepared by a mechanical method from natural animal fibers selected from wool, cattle hair, horse hair, rabbit hair, camel hair, yak hair and/or human hair, the average diameter of said animal hair micro powder particles being 0.01-10 μm.

2. The composition of claim 1, further comprising a second monomer, and said second monomer selected from acrylic acid, methyl acrylate, ethyl acrylate, butyl acrylate, 2-hydroxyethyl acrylate, methacrylic acid, methyl methacrylate, ethyl methacrylate, propyl methacrylate, butyl methacrylate, 2-hydroxyethyl methacrylate, styrene, methyl styrene, vinyl acetate, methylenebutanedioic acid, vinyl chloride, vinylidene chloride, vinyl bromide, vinylidene bromide, vinylidene fluoride, and a mixture thereof, wherein the weight ratio of the components is as follows: acrylonitrile monomer 30.0-96.9% by weight; initiator 0.1-0.4% by weight; animal hair micro powder 1.0-50.0% by weight; and a second monomer 2.0-20.0% by weight.

3. The composition of claim 2, further comprising a third monomer, and said third monomer comprises at least one component selected from sodium methacrylate sulfonate, sodium methallyl sulfonate, sodium allylsulfonate, sodium styrene sulfonate, sodium vinyl sulfonate, sodium vinyl sulfonate, sulfoalkyl acrylate, and sulfoalkyl methacrylamide; wherein the weight ratio of the components is as follows: acrylonitrile monomer 20.0-96.8% by weight; initiator 0.1-0.4% by weight; animal hair micro powder 1.0-50.0% by weight; a second monomer 2.0-20.0% by weight; and a third monomer 0.1-10.0% by weight.

4. The composition of claim 1, further comprising 0.1-0.6% by weight chain transfer agents selected from dodecyl mercaptan, N-octyl mercaptan, β-mercaptoethanol, and isopropanol.

5. The composition of claim 2, further comprising 0.1-0.6% by weight chain transfer agents selected from dodecyl mercaptan, N-octyl mercaptan, β-mercaptoethanol, and isopropanol.

6. The composition of claim 3, further comprising 0.1-0.6% by weight chain transfer agents selected from dodecyl mercaptan, N-octyl mercaptan, β-mercaptoethanol, and isopropanol.

7. The composition of claim 3, comprising: 20.0-89.2% by weight of said acrylonitrile monomer, 0.1-0.3% by weight of said initiator, 5.0-45.0% by weight of said animal hair micro powder, 5.0-15.0% by weight of said second monomer, and 0.5-3.0% by weight of said third monomer; wherein said micro powder has average particle diameter of 0.05-3 μm, said second monomer is selected from vinyl chloride, vinylidene chloride, vinyl bromide, vinylidene bromide, and vinylidene fluoride, the molecular weight of said polyacrylonitrile is 25000-90000, and the filament titer of said fiber is 30-100 dtex.

* * * * *